US006110324A

United States Patent [19]

Trokhan et al.

[11] Patent Number: 6,110,324

[45] **Date of Patent: *Aug. 29, 2000**

[54] PAPERMAKING BELT HAVING REINFORCING PILES

[75] Inventors: Paul D. Trokhan, Hamilton; Larry L. Huston, West Chester, both of Ohio

[73] Assignee: The Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 09/104,793

[22] Filed: Jun. 25, 1998

[51] Int. Cl.[7] ..... D21F 3/00

[52] U.S. Cl. ..... 162/358.2

[58] Field of Search ..... 139/383 A, 425 A; 162/358.2, 900–903; 428/247, 135, 138; 156/290, 272.2, 275.1, 435, 500, 537, 540

[56] References Cited

U.S. PATENT DOCUMENTS

| | | | |
|---|---|---|---|
| 3,657,068 | 4/1972 | Ivanowicz | 162/358 |
| 4,172,910 | 10/1979 | Rotar . | |
| 4,251,928 | 2/1981 | Rotar et al. . | |
| 4,440,597 | 4/1984 | Wells et al. . | |
| 4,467,839 | 8/1984 | Westhead | 139/383 |
| 4,514,345 | 4/1985 | Johnson et al. . | |
| 4,528,239 | 7/1985 | Trokhan . | |
| 5,098,522 | 3/1992 | Smurkowski et al. . | |
| 5,260,171 | 11/1993 | Smurkoski et al. . | |
| 5,275,700 | 1/1994 | Trokhan . | |
| 5,328,565 | 7/1994 | Rasch et al. . | |
| 5,334,289 | 8/1994 | Trokhan et al. . | |
| 5,429,686 | 7/1995 | Chiu et al. . | |
| 5,431,786 | 7/1995 | Rasch et al. . | |
| 5,496,624 | 3/1996 | Stelljes, Jr. et al. . | |
| 5,500,277 | 3/1996 | Trokhan et al. . | |
| 5,503,715 | 4/1996 | Trokhan et al. . | |
| 5,514,523 | 5/1996 | Trokhan et al. . | |
| 5,554,467 | 9/1996 | Trokhan et al. . | |
| 5,566,724 | 10/1996 | Trokhan et al. . | |
| 5,614,061 | 3/1997 | Van Phan et al. . | |
| 5,624,790 | 4/1997 | Trokhan et al. . | |
| 5,628,876 | 5/1997 | Ayers et al. . | |
| 5,672,248 | 9/1997 | Wendt et al. . | |
| 5,679,222 | 10/1997 | Rasch et al. . | |

FOREIGN PATENT DOCUMENTS

| | | |
|---|---|---|
| 0 677 612 A2 | 10/1995 | European Pat. Off. . |
| WO 95/27821 | 10/1995 | European Pat. Off. . |
| 36 00 530 | 7/1987 | Germany . |

*Primary Examiner*—Stanley S. Silverman
*Assistant Examiner*—Robert E. McBride
*Attorney, Agent, or Firm*—Larry L. Huston; Donald E. Hasse; Jacobus C. Rasser

[57] ABSTRACT

A woven papermaking belt having a paper contacting top surface plane and an opposed backside. The belt comprises a fabric having yarns disposed, in part, in the top surface plane to form knuckles. The belt further comprises reinforcing piles extending from a proximal end to a distal end. The distal ends of the reinforcing piles are disposed between the top surface plane of the papermaking belt and the backside of the papermaking belt. The reinforcing piles resist applied loads and may prevent deflection of the knuckles during the papermaking process. The applied loads may either be normal to the belt, as occurs during imprinting, within the plane of the belt, which causes sleaziness of the belt, or both. The belt according to the present invention may have piles with proximal ends disposed at two or more different elevations, as well as distal ends, which are disposed at two or more elevations. This arrangement provides a belt which imprint different densities onto paper during papermaking, according to the ability of the piles to resist compressive loads applied normal to the plane of the belt. In one alternative embodiment, the piles may be disposed between the first and second layers of a multi-layer papermaking belt. The belt according to the present invention is particularly suitable for woven papermaking fabrics having long, unsupported knuckles.

21 Claims, 2 Drawing Sheets

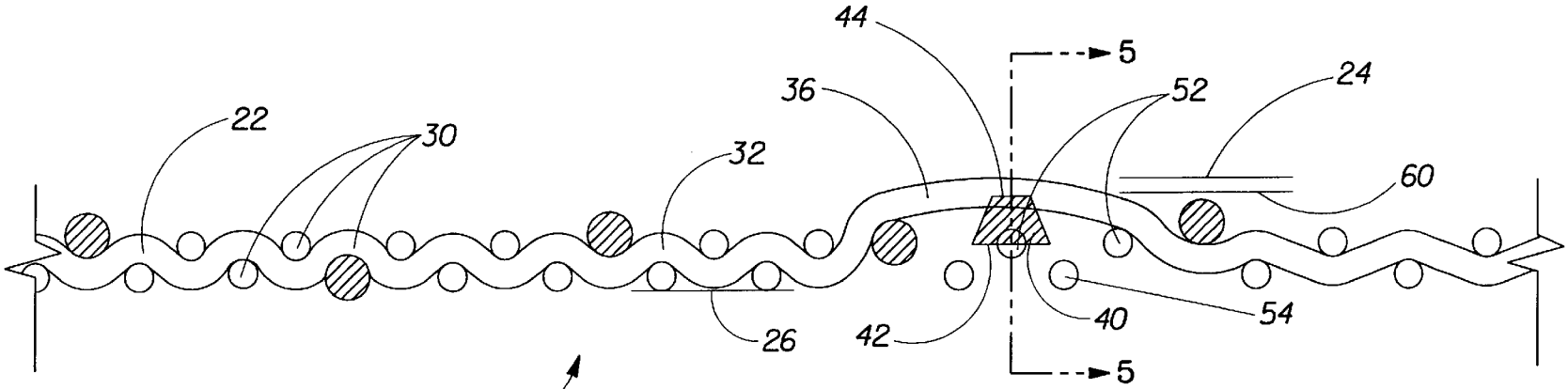
Fig. 3
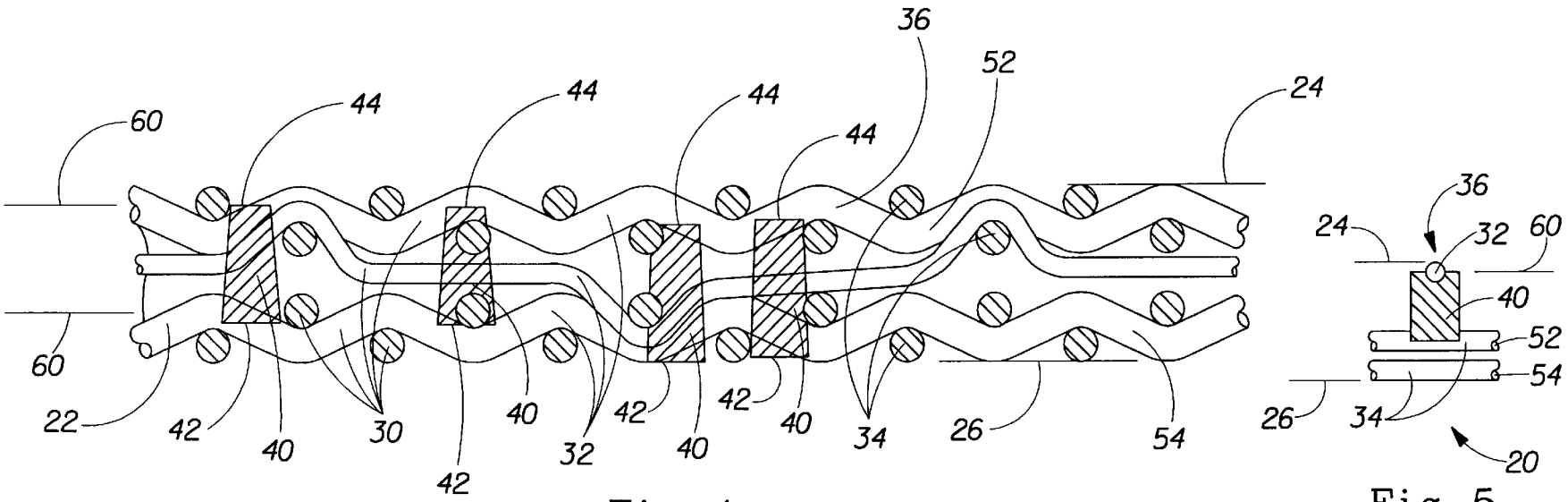
Fig. 4
Fig. 5

PAPERMAKING BELT HAVING REINFORCING PILES

FIELD OF INVENTION

This invention relates to papermaking belts, and more particularly to belts having augmented resistance to compression perpendicular to the plane of the belt, and/or mitigated sleaziness within the plane of the belt.

BACKGROUND OF THE INVENTION

Through air drying is well known in the papermaking art. Through air drying has been advantageously accomplished with commercial success using belts having two components, a foraminous element and a resinous framework. Such belts are disclosed in commonly assigned U.S. Pat. No. : 4,514,345, issued Apr. 30, 1985 to Johnson et al.; U.S. Pat. No. 4,528,239, issued Jul. 9, 1985 to Trokhan; U.S. Pat. No. 5,098,522, issued Mar. 24, 1992; U.S. Pat. No. 5,260,171, issued Nov. 9, 1993 to Smurkoski et al.; U.S. Pat. No. 5,275,700, issued Jan. 4, 1994 to Trokhan; U.S. Pat. No. 5,328,565, issued Jul. 12, 1994 to Rasch et al.; U.S. Pat. No. 5,334,289, issued Aug. 2, 1994 to Trokhan et al.; U.S. Pat. No. 5,431,786, issued Jul. 11, 1995 to Rasch et al.; U.S. Pat. No. 5,496,624, issued Mar. 5, 1996 to Stelljes, Jr. et al.; U.S. Pat. No. 5,500,277, issued Mar. 19, 1996 to Trokhan et al., U.S. Pat. No. 5,514,523, issued May 7, 1996 to Trokhan et al.; U.S. Pat. No. 5,554,467, issued Sep. 10, 1996, to Trokhan et al.; U.S. Pat. No. 5,566,724, issued Oct. 22, 1996 to Trokhan et al.; U.S. Pat. No. 5,624,790, issued Apr. 29, 1997 to Trokhan et al.; U.S. Pat. No. 5,628,876, issued May 13, 1997 to Ayers et al., and U.S. Pat. No. 5,679,222 issued Oct. 21, 1997 to Rasch et al. all of which patents are incorporated herein by reference.

Papermaking using two belts is also known in the art. Each belt may have a foraminous element and a patterned framework. One belt is used for the forming wire and one is used for the drying belt. The art also teaches discrete pattern elements in the framework, particularly for the forming wire. Suitable examples are found in commonly assigned U.S. Pat. No. 5,503,715 issued Apr. 2, 1996 to Trokhan et al. and U.S. Pat. No. 5,614,061 issued Mar. 25, 1997 to Phan et al., which patents are incorporated herein by reference.

One feature common to each of these patents is the presence of the patterned framework at or above the plane of the foraminous element. The foraminous element serves as a reinforcing structure for the resinous framework. The patterned framework provides deflection conduits for embryonic webs during the papermaking process, and imprints a high density pattern onto the paper formed thereby. The deflection conduits may be discrete, semicontinuous or continuous.

Recently, attempts have been made to design through air drying belts which do not rely upon a resinous framework to provide deflection conduits or imprint the paper. For example, PCT Application WO 95/27821, published Oct. 19, 1995 in the name of Chiu et al., and European Patent Application 0 677 612 A2, published Oct. 18, 1995 in the names of Wendt et al. disclose through drying fabrics which allegedly impart significantly increased cross direction extensibility to the resulting product, while at the same time allegedly also delivering high bulk. Such fabrics may have a top layer dominated by long warp knuckles, and no top surface shute knuckles. Many of these long warp knuckles have no supporting shutes underneath for resistance to compression which occurs during papermaking, particularly during imprinting. The disclosures of the Wendt and Chiu applications are incorporated herein by reference for the limited purpose of showing how to make papermaking fabrics having a jacquard-like weave pattern. Papermaking fabrics woven on a dobby loom or a multiple harness loom may also be suitable for use with the claimed invention. Likewise, clothing woven on more typical looms may also be suitable for use with the claimed invention.

One problem which appears inherent to this approach, or any approach having warps (or shutes) with long unsupported spans, is deflection of the warps (or shutes) during the papermaking process. Such deflection may prevent the fabric from fully imprinting the paper. Collapse of the clothing will have a deleterious effect on the embryonic web, likely reducing its bulk. Imprinting increases fiber-to-fiber bonding and is typically accomplished in conjunction with a Yankee drying drum, but may also be accomplished with other suitable roll/nip combinations or other rigid surfaces. For example, extended nip presses or shoe presses may be used for imprinting. Imprinting has been commercially successful in improving the softness/strength relationship of tissue. Such commercial success is due to the consumer acceptance of multi-region tissue papers created by the combination of imprinting and the deflection conduits.

Wendt et al. purport to avoid the problem associated with deflection of long spans by not imprinting the paper. To do this, Wendt et al. forego the Yankee drying drum and creping operation. However, this approach is infeasible for the large number of existing papermaking plants which rely upon a Yankee drying drum to complete the drying process. Furthermore, not creping the paper can make it difficult to impart adequate machine direction stretch to the final product. In addition, the absence of imprinted (high density) regions often yields tissue with a poorer softness/strength relationship.

Wendt et al. purport to overcome the problems associated with the absence of creping by allegedly making an uncreped through air dried microcontracted sheet. Microcontraction is known from commonly assigned U.S. Pat. No. 4,440,597, issued Apr. 3, 1984 to Wells et al., which patent is incorporated herein by reference. Microcontraction occurs when the paper is transferred from a faster moving first fabric, such as a forming wire, to a slower moving second fabric, such as a through drying fabric or a transfer fabric. However, microcontraction inherently slows the papermaking process to the limiting speed of the slower moving fabric. Slowing the papermaking process increases the cost of manufacture and limits the papermaking capacity of the machinery. Microcontraction of the paper also tends to deteriorate softness and tensile strength.

A different problem known in the art and associated with through air drying belts is sleaziness. Sleaziness refers to movement of warp and shute yarns within the plane of the belt relative to each other. Sleaziness most often occurs with high shed count fabrics. This problem is exacerbated in those fabrics having long floats, as illustrated in the aforementioned Wendt et al. application. Furthermore, fabrics having low density (high projected open area or high void volume) weaves are also prone to sleaziness problems.

Sleaziness can also occur with multi-layer fabrics. Multilayer fabrics include dual layer fabrics and triple layer fabrics. Dual layer fabrics have stacked warps tied together by the shutes or vice versa. A triple layer fabric has independent first and second layers juxtaposed in face-to-face relationship and held in place by tie yarns. In a multi-layer fabric sleaziness can occur with movement of one layer of the fabric relative to the other layer of the fabric and/or with movement of warps and shutes relative to other warps and shutes within the same layer.

Yet another problem known in the art and associated with papermaking belts is seam strength. Fabrics made on conventional looms are seamed to provide an endless belt suitable for use in papermaking. Resistance to machine direction failure of the seam in tension is known as seam strength. Seam strength is particularly critical in the aforementioned fabrics having high shed counts, low density or long floats.

Accordingly, in one aspect, this invention may provide a papermaking belt having knuckles adequately supported for imprinting of the paper. Furthermore, in one aspect, this invention may provide a papermaking belt having either long warp knuckles, long shute knuckles, or both, which are adequately supported. In one aspect, this invention may further provide such a belt which can be used with a Yankee drying drum or other means for imprinting the tissue. Further, in one aspect, this invention may provide for both single layer and multi-layer papermaking belts having mitigated sleaziness for a particular weave.

SUMMARY OF INVENTION

The invention comprises a papermaking belt. The papermaking belt has a top surface plane and a backside opposed to the top surface plane. The belt comprises a fabric having a plurality of interwoven yarns. The belt further comprises a plurality of piles, each pile extends from a proximal end to a distal end. The proximal end may be juxtaposed with the backside of the belt or at an elevation above the backside of the belt. The distal end is intermediate the backside and the top surface plane of the belt. The pile may intercept a yarn, whereby the pile supports the yarn from deflection normal to and/or within the plane of the belt.

The papermaking belt may be a multi-layer papermaking belt. In a multi-layer belt, a first plurality of yarns forms a first layer and a second plurality of yarns forms a second layer. The piles may extend from proximal ends juxtaposed with the backside of the belt to distal ends. The distal ends of the piles may be juxtaposed with the first layer of yarns, the second layer of yarns, other suitable elevations or a combination thereof Similarly, the proximal ends of the piles may be juxtaposed with the backside of the belt, with the first or second layer of yarns, other suitable elevations or a combination thereof.

BRIEF DESCRIPTION OF THE DRAWINGS

FIG. 3 is a vertical sectional view of an alternative embodiment according to the present invention showing a fabric weavable on a jacquard loom and having the proximal end of the pile coincident the first layer of the fabric below the knuckle.

FIG. 4 is a vertical sectional view of an alternative embodiment according to the present invention showing a multi-layer fabric having adjunct tie yarns, with first piles having the proximal and distal ends juxtaposed with the mid-planes of the two layers of the fabric, and second piles having the proximal ends juxtaposed with the backside of the belt.

FIG. 5 is a vertical sectional view taken along lines 5—5 of FIG. 3.

DETAILED DESCRIPTION OF THE INVENTION

Figure 1:
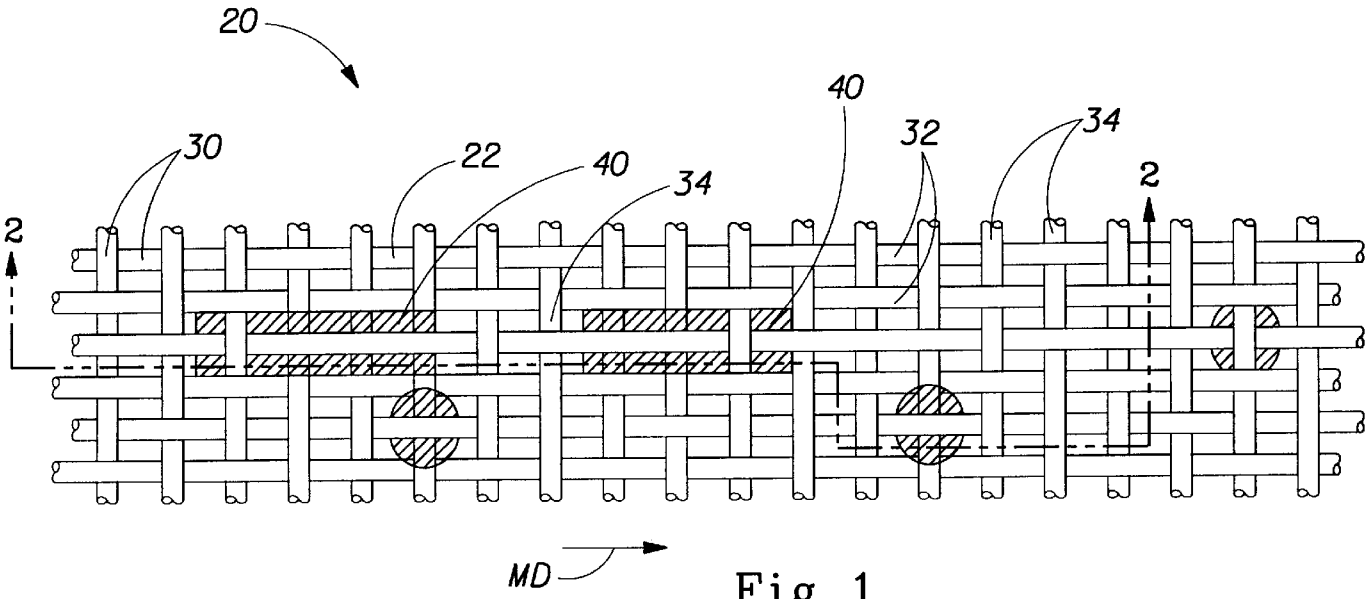
FIG. 1 is a top plan view of a belt according to the present invention.

Referring to FIG. 1, the present invention comprises a papermaking belt 20 having a fabric 22 and reinforcing piles 40. The fabric 22 comprises interwoven yarns 30. The yarns 30 comprise warps 32 and shutes 34, principally oriented in the machine direction and cross machine direction, respectively.

In accordance with the present invention, the papermaking belt 20 may be a forming wire, a backing wire for a twin wire former, a transfer fabric, a base for a press felt, or a through drying fabric. The papermaking belt 20 will be discussed below as a through drying fabric, although it is to be recognized that other executions are feasible for the claimed invention.

The belt 20 according to the present invention is macroscopically monoplanar. The plane of the belt 20 defines the XY directions. Perpendicular to the XY directions and plane of the belt 20 is the Z-direction of the belt. Likewise, the paper made on the belt 20 according to the present invention may be thought of as macroscopically monoplanar and lying in an XY plane. Perpendicular to the XY directions and the plane of the paper is the Z-direction of the paper.

Figure 2:
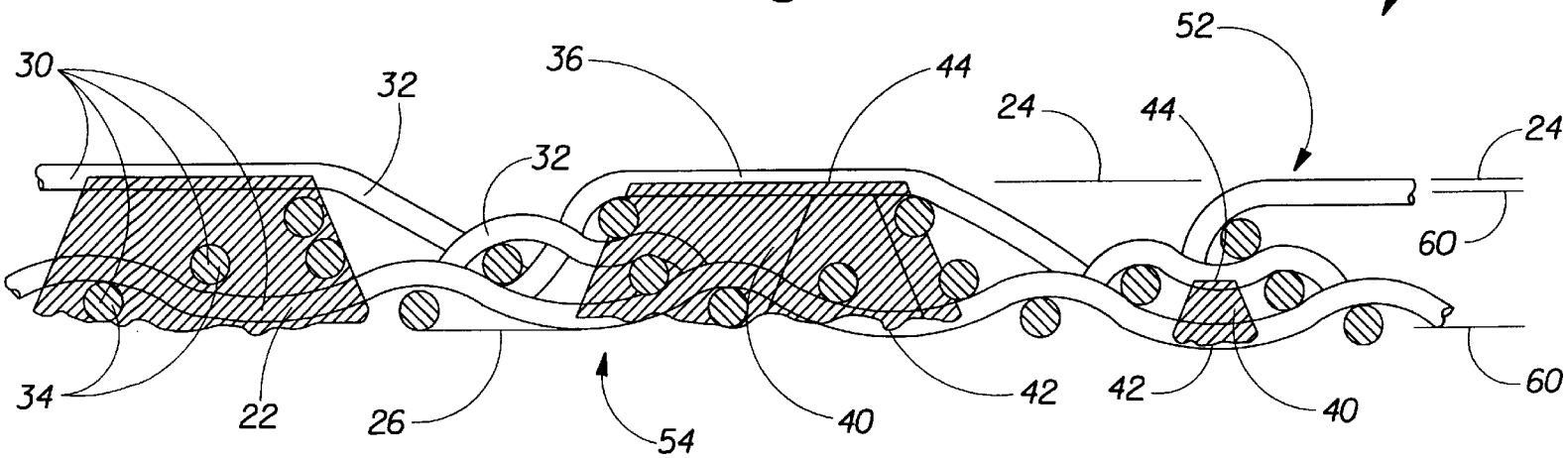
FIG. 2 is a vertical sectional view taken along lines 2—2 of FIG. 1, and having piles with proximal ends coincident the backside of the belt and a pile with the proximal end coincident the mid-plane of the second layer of the fabric. The distal ends of the piles having proximal ends coincident the backside are juxtaposed with the knuckles. The distal end of the pile having the proximal end coincident the midplane of the second layer is juxtaposed with the sub-top surface first layer yarn. However, it is to be recognized that the configuration illustrated in FIG. 2 may be reversed.

The papermaking belt 20 of FIG. 1 and 2 has knuckles 36, and preferably long knuckles 36 which impart the aforementioned impressions. A "knuckle" refers to any paper-contacting yarn in the top surface plane 24. A "long knuckle" refers to the knuckle of a warp 32 or shute 34 having a length sufficient to cross two or more shutes 34 or warps 32, respectively. The "top surface plane 24" of the belt 20 refers to the paper contacting surface of the belt 20. Conversely, the "backside 26" of the belt 20 is the machine contacting surface of the belt 20.

The paper made on the belt 20 and according to the process of the present invention may have a basis weight of 10 to 70 grams per square meter, and 3–300 preferably 10 to 150 knuckle impressions per square inch and more preferably 10 to 50 knuckle impressions per square inch. Each impression corresponds to the position and pattern provided by a knuckle 36 and preferably long knuckle 36 in the papermaking belt 20 of the present invention.

It is to be recognized that the warps 32 and shutes 34 may be corporately provided in a pattern which imprints the paper with relatively complex indicia such as Christmas trees, fish, butterflies, flowers, etc. More complex indicia may be created by weaving the fabric 22 on a jacquard or dobby loom. Complex indicia may also be woven on a high harness count loom or a loom having one or more heddle frames as are known in the art. For example, a 24 harness loom may be suitable.

Various fabrics 22 may be used for the belt 20 according to the present invention. Suitable single layer fabrics 22 are found in commonly assigned U.S. Pat. No. 3,905,863 issued Sep. 16, 1975 to Ayers and U.S. Pat. No. 4,239,065 issued Dec. 16, 1980, to Trokhan, which patents are incorporated herein by reference.

Other suitable fabrics 22 include multi-layer fabrics 22, commonly referred to as dual and triple layer fabrics 22, as shown in FIGS. 2 and 4. Referring to FIG. 4, one type of multi-layer fabric 22 has the yarns 30 woven together to form independent first and second layers 52, 54. These layers 52, 54 are tied together in face-to-face relationship. A first plurality of yarns 30 is woven to form the first layer 52. The first layer 52 of the fabric 22 is juxtaposed with and preferably defines the top surface plane 24 of the belt 20. A second plurality of yarns 30 is woven to form the second layer 54 of the fabric 22. The second layer 54 of the fabric 22 is juxtaposed with and preferably defines the backside 26 of the belt 20. The first layer 52 and second layer 54 of the fabric 22 are joined together in face-to-face relationship using tie yarns 30, as is well known in the art. The top surface plane 24 and backside 26 are thus defined by the outwardly oriented surfaces of the first and second layers 52, 54, respectively of the multi-layer fabric 22. Either integral or adjunct tie yarns 30 may be used for joining the two layers 52, 54.

Referring to FIGS. 1 and 2, another type of multi-layer fabric 22 has the yarns woven together without independent first and second layers 52, 54. In such fabrics, the first plurality of yarns 30 disposed closest to the top surface plane 24 of the belt act as an apparent first layer 52 providing support for the paper disposed thereon. A second plurality of yarns 30 is disposed closest to the backside 26 of the fabric 22. The second plurality of yarns acts as an apparent second layer 54, providing a machine contacting surface and support for any yarns 30 disposed thereabove.

In an alternative embodiment the piles 40 may not only augment but replace the tie yarns 30. Upon curing the piles 40 may hold the first and second layers 52, 54 of the multi-layer fabric 22 in the face to face relation without relying upon the tie yarns 30.

Suitable multi-layer fabrics 22 are disclosed in commonly assigned U.S. Pat. No. 5,664,724 issued Oct. 22, 1996 to Trokhan et al.; U.S. Pat. No. 5,500,277 issued Mar. 19, 1996 to Trokhan et al., U.S. Pat. No. 5,496,624 issued Mar. 5, 1996 to Stelljes, Jr. et al. which patents are incorporated herein by reference.

Still referring to FIG. 2, reinforcing piles 40 are applied to any of the fabrics 22 discussed above, or to any other suitable fabric 22. Each pile 40 extends from a proximal end 42 juxtaposed with, or even coincident, the backside 26 of the belt 20 to a distal end 44. The distal end 44 of the pile 40 may intercept one of the knuckles 36 of the fabric 22. As discussed below, the distal ends 44 of the piles 40 do not extend outside, or above, the top plane 24 of the fabric 22. Alternatively stated, the distal ends 44 of the piles 40 are intermediate the top surface plane 24 and the backside 26 of the fabric 22. By "intermediate" it is meant the distal end 44 of the pile 40 is disposed between the backside 26 and top surface plane 24.

The piles 40 may comprise a framework having an essentially continuous pattern, as illustrated in the aforementioned and incorporated U.S. Pat. No. 4,637,859, a semicontinuous pattern as illustrated in the aforementioned and incorporated U.S. Pat. No. 5,628,876, or preferably in a discrete pattern as illustrated in the aforementioned and incorporated U.S. Pat. Nos. 4,514,345 and 5,245,025. Discrete patterns are preferred for the reinforcing piles 40, because discrete patterns can provide the least obstruction to air flow through the belt 20 for a given amount of support to the knuckles 36. Furthermore, discrete piles 40 are readily disposed in positions to support the knuckles 36, in positions intermediate the knuckles 36, or in combinations thereof In the belts according to the prior art, the framework extends to or above the top plane of the fabric 22. Such arrangements are contemplated to be outside the present invention.

It is preferred that long unsupported warp 32 (or shute 34) knuckles 36 are supported by the piles 40. By "unsupported" it is meant that no structural element is present between the knuckles 36 and the balance of the fabric 22 to resist compression of the knuckle 36 in the direction perpendicular to the plane of the belt 20, although it is to be recognized that sub-topsurface crossovers may exist wherein a shute 34 or warp 32 crosses under the knuckle 36 without contacting or resisting compression of the knuckle 36. According to the present invention, a pile 40 may be present between the bottom side of the knuckle 36 and the backside 26 of the belt 20. The pile 40 supports the knuckle 36. Such support from the piles 40 minimizes deflection of the knuckle 36 under compressive loads applied perpendicular to the plane of the belt 20.

Preferably, according to the present invention, to support the knuckles 36, particularly the long knuckles 36, the piles 40 do not extend above the top plane 24 of the fabric 22. In such an arrangement the piles 40 need only extend from the backside 26 of the fabric 22 to an elevation where the distal end 44 is below or coincident the top surface plane 24 of the belt 20. It is to be recognized that a pile 40 may be used to support any portion of any yarn 30, and particularly the portion of such yarn 30 which forms part of the top surface plane 24 of the fabric 22. However, it is believed that the piles 40 will be most useful supporting the knuckles 36, and particularly the long knuckles 36, of the fabric 22.

More preferably, to prevent the piles 40 from forming part of the imprint pattern of the belt 20, the piles 40 extend from the backside 26 of the belt 20 to an elevation coincident the mid-plane 60 of the warps 32 or shutes 34 which form the knuckles 36. The mid-plane 60 is that plane through the center (regardless of cross-sectional shape) of the yarn 30 comprising the knuckle 36. This arrangement cradles the knuckle 36 in the top surface plane 24 of the belt 20 while providing a column to resist deflection of the knuckle 36. The pile 40 acts as a column, compressively supporting the knuckle 36 against the backside 26 of the fabric 22, and ultimately against the papermaking machinery supporting the fabric 22.

According to the present invention, the weave of the through drying fabric 22 forms the knuckles 36 and hence the impression pattern, if any, on the paper. It is to be recognized that, additionally, a further imprint pattern may be provided by having a patterned framework coincident the elevation of the knuckles 36 of the top surface plane 24. Such an additional patterned framework may be made according to any of the aforementioned and incorporated U.S. Pat. Nos. 4,637,859; 5,628,876; and/or U.S. Pat. No. 5,143,345 as is known in the art.

The piles 40 may be provided and installed in the belt 20 in one or more of several manners. The piles 40 may comprise resin. The resin may be cured by actinic radiation, may be thermally cured, or cured by any other suitable means.

In the first manner, the liquid resin, the fabric 22, and a mask having transparent and opaque regions are provided, as disclosed in the aforementioned and incorporated U.S. Pat. Nos. 4,514,345; 4,528,239; 5,098,522; 5,275,700; and 5,334,289. The mask has transparent regions registered with the desired locations of the piles 40, and opaque regions where it is desired not to have piles 40. The fabric 22 is immersed in the liquid resin. The resin is then provided to a depth sufficient to support the desired yarn 30 but which does not extend above the top plane 24 of the fabric 22. The resin is then cured into piles 40 as disclosed in the aforementioned patents U.S. Pat. Nos. 4,514,345; 4,528,239; 5,098,522; 5,275,700; and 5,334,289 to yield piles 40 in the desired position and height. The proximal ends 42 of the piles 40 may be provided with a backside texture, as is known in the art.

The X-Y position of the piles 40 is determined by the transparent regions of the mask. The Z-direction height of the piles is determined by the depth of the resin prior to curing. The resin is cured into the piles by passing actinic radiation through the transparent regions of the mask and curing the liquid resin therebeneath into solid piles 40.

The transparent regions of the mask may be registered with the long knuckles 36 either visually, or by creating a Moire interference pattern. To create such a Moire interference pattern, the mask is preprinted with transparent regions registered with the size, pitch and overall geometry of the long knuckles 36. The transparent regions are then registered with such knuckles 36 in a position which minimizes the interference pattern at the knuckles 36.

It is to be understood that the long knuckles 36, or any other portions of the yarns 30, where one desires to dispose piles 40 at a particular XY position should be transparent to the actinic radiation. Such transparency allows for sufficient curing of any photosensitive resin therebeneath.

If a multi-layer fabric 22 is used with the present invention, as is known in the art, the second layer 54 may have a plurality of opaque yarns 30. The opaque yarns prevent curing of photosenstive resin therebeneath. And yet another embodiment, the first layer 52 of the fabric 22 may be provided with a plurality of opaque yarns 30 for the same purpose. Of course, one of ordinary skill will recognize the yarns 30 in either layer 52, 54 of a multi-layer fabric 22 or the yarns 30 of a single layer fabric 22 may be opaque, if desired.

If thermally curable resin is used, the knuckles 36 may provide for transmission of the heat, while the other regions of the fabric 22 insulate the resin from the heat, preventing it from curing.

Resin which remains uncured, either from actinic radiation or heat, is then washed away by showers, providing flow through area in the fabric 22. It is important that the papermaking belt 20 allows sufficient air flow so that efficient drying is obtained.

Alternatively, uncured resin can be selectively vacuumed or air knifed with positive pressure from the fabric 22 prior to curing. Particularly, the resin may be selectively vacuumed from the regions where piles 40 are not desired. Prophetically, such a process will remove resin from the large foramina between yarns in the X-Y plane, but will allow resin to remain which is trapped between yarns 30 separated in the Z-direction.

Alternatively, it is not necessary that curable resin be used for the piles 40. The piles 40 may be provided by an externally introduced means for supporting the knuckles 36. Examples of externally introduced piles 40 include thermoplastic material applied from the backside 26 of the belt 20 and impressed to the elevation of the belt coincident the knuckles 36. Epoxies, moldable clays, or puddies may be similarly applied and externally introduced.

Alternatively, bicomponent dual melting point yarns 30 may be used for weaving the fabric 22. Such yarns 30 have an external sheath and an internal core. The core has a higher melting point than the sheath. To make the belt 20 of the present invention, first the fabric 22 is woven from the biocomponent yarns 30. The fabric 22 is then disposed on a flat, rigid horizontal support surface with the backside 26 downwardly oriented. Heat is locally applied to the fabric 22, but limited to the regions juxtaposed with the knuckles 36. The heat melts the sheath of the yarns 30, at XY positions coincident the knuckles 36 or any other desired position. The melted sheath material flows downward to the horizontal support surface. The horizontal support surface acts as a heat sink. There, the sheath material resolidifies, forming a pile 40 between the bottom of the knuckles 36 and the backside 26 of the belt 20.

Referring to FIGS. 3, 4 and 5, it will be apparent to one skilled in the art that several variations in the papermaking belt 20 according to the present invention are contemplated. For example, if a multi-layer fabric 22 is used for the papermaking belt 20, the piles 40 need only extend between the yarns 30 comprising the first layer 52 of the fabric 22 and the yarns 30 comprising the second layer 54 of the fabric 22.

Such a belt 20 may prophetically be made by first providing a suitable multi-layer fabric 22. The fabric 22 is then backfilled to the desired elevation with a removable material. Such removable materials prevents curing of the resin below the desired elevation. As used herein, "elevation" refers to the Z-direction distance from the backside 26 of the belt 20, towards the top plane 24 of the belt 20. Backfilling is disclosed in commonly assigned U.S. Pat. No. 5,629,052, issued May 13, 1997 to Trokhan et al., and U.S. Pat. No. 5,674,663 issued Oct. 7, 1997 to McFarland et al., which patents are incorporated herein by reference.

The resin from which the piles 40 are formed is then provided to the desired elevation in the first layer 52 of the papermaking fabric 22. The resin is cured and the backfill material subsequently removed.

From the discussion above, it will be recognized that the yarns 30 comprising the second layer 54 of the fabric 22 have a mid-plane 60. Referring to FIG. 5, in one particular embodiment, the backfill material is provided to an elevation which intercepts the mid-plane 60 of the yarns 30 of the second layer 54. Similarly, the resin is provided to a depth which originates from and intercepts the mid-plane 60 of the yarns 30 of the second layer 54. Of course, the resin can be then provided to an elevation wherein the distal ends 44 of the piles 40 intercept the mid-plane 60 of the first layer 52 of the fabric 22.

Such an arrangement yields knuckles 36 which provide local columnar support for the papermaking belt 20. Such support is limited to the portion of the belt 20 defined by and between the first layer 52 of the belt 20 and the second layer 54 of the belt 20. Compressive loads applied normal to the plane of the belt 20 are transferred from the first layer 52 through the piles 40 to the second layer 54, and ultimately to the papermaking machinery contacting the backside 26 of the belt 20. Such an embodiment provides the advantage of flexibility in the first layer 52 while still reinforcing the knuckles 36 against the second layer 54.

Referring to FIG. 4, the proximal ends 42 of a first plurality of piles 40 may be juxtaposed with the backside 26 of the fabric 22. Particularly, some of piles 40 may have the proximal ends 42 coincident the backside 26. The proximal ends 42 of a second plurality of piles 40 may be juxtaposed with the second layer 54 of the fabric 22. The distal ends 44 of the piles 40 may have a common elevation (as shown) or may be disposed at different elevations. For example, the distal ends 44 of the first plurality of piles 40 may be coincident the top surface plane 24 of the belt 20 or coincident the mid-plane 60 of the yarns 30 forming the knuckles 36, or disposed at some other elevation. The elevations of the distal ends 44 of the other plurality of piles 40 may be disposed at different elevation than the distal ends 44 of the first plurality of piles 40.

The arrangement shown in FIG. 4, having piles 40 with proximal ends 42 and distal ends 44 at different elevations may be provided as follows. First, the resin which is cured into the piles 40 having proximal ends 42 coincident the backside 26 of the belt is provided to the desired depth and cured. The uncured resin is washed away, producing piles 40 having proximal ends 42 coincident the backside 26 of the fabric 22 and distal ends 44 at the desired elevation. The backfill material is then added as described above. Liquid resin is again cast to the desired depth and cured into the piles 40 having the proximal ends 42 disposed at a relatively higher elevation in the fabric 22, (such as the mid-plane 60 of the second layer 54).

Alternatively, the process may be reversed. The backfill material may be added and the piles 40 having the proximal ends 42 disposal at the relatively higher elevation may be cast first. The uncured resin and backfill material are then washed away. Resin is then added coincident the backside 26 of the fabric 22 and cured into piles 40 having proximal ends 42 coincident the backside 26 as shown, or disposed at any other suitable elevation. The pre-cure depth of the resin again determines the elevation of the distal ends 44 of the piles 40.

This process yields a belt 20 having piles 40 with proximal ends 42 juxtaposed not only with the backside 26 of the belt 20, but also having proximal ends 42 juxtaposed with the second layer 54 of the fabric 22 of the belt 20. This hybrid arrangement provides the benefit of a belt 20 having regions of different first and second resistances to applied compression. The regions coincident the piles 40 having the proximal ends 42 coincident the backside 26 of the belt 20 will have a greater resistance to compression than the regions of the belt 20 having piles 40 with proximal ends 42 supported by other yarns 30 of the fabric 22.

Such a hybrid belt 20 will applied different first and second imprint densities to the paper. A first and greater imprint density will be provided by the piles 40 having the proximal ends 42 juxtaposed with the backside 26 of the belt 20. A second and lesser imprint density will be provided by the piles 40 having proximal ends juxtaposed by yarns 30 in the fabric 22, and particularly by yarns 30 in the second layer 54 of the fabric 22. It is to be recognized that the actual imprint on the paper is provided by the knuckles 36 of the belt 20. However, the imprint density of the knuckles 36 is determined, in part, by the elevation of the proximal end 42 of the pile 40 registered with that knuckle 36.

The benefit of a belt 20 having the hybrid pile 40 arrangement is that the first piles 40, having the proximal ends 42 coincident the backside 26 of the belt will provide a solid imprint against the Yankee drying drum, or other solid surface. The second piles 40 having the proximal ends 42 disposed at elevations above the backside 26 of the belt 20 will not provide a solid imprint, but still contribute to buckling of the paper at the low density region of a multi-density paper. The hybrid belt 20 provides two different imprint densities on the paper.

The two different imprint densities may be arranged to provide any aesthetically pleasing pattern. For example, the first and greater imprint density may be provided in a pattern of decorations such as hearts, flowers, butterflies, holiday ornamentation, etc. The second and lesser imprint density may be provided in a grid, lattice-work or matrix which provides a quilted appearance for the paper. The grid, lattice-work or matrix may form an array of cells. One of the decorative embodiments may be disposed in each cell. Alternatively, a plurality, but less than all of the cells, may have a decorative imprint pattern therein. For example, one-third to one-half of the cells may have a decorative imprint therein.

Referring to FIG. 3, in yet another embodiment the piles 40 may extend from a proximal end 42 coincident the first layer 52 of the fabric 22. The distal ends 44 of the piles 40 may intercept the knuckles 36, and preferably the mid-plane 60 of the knuckles 36. It will be apparent that the piles 40 may be provided with proximal ends 42 and distal ends 44 at other suitable elevations as well.

In yet another alternative embodiment (not shown) the proximal ends 42 of the piles 40 may extend outwardly beyond the bottom plane of the fabric 22. In such an embodiment, the backside 26 of the belt 20 is still defined by the proximal ends 42 of the piles 40. However, the fabric 22 is elevated above the backside 26 of the papermaking belt 20. In such an embodiment, the fabric 22 would rarely, if ever, contact the papermaking machinery used to produce paper on the belt 20 according to the present invention.

The piles 40 may be used to resist deformation of the belt 20 in the X-Y plane, and thereby mitigate sleaziness. For example, the piles 40 may be juxtaposed with the areas of the belt 20 anticipated to have the greatest sleaziness. Particularly, the piles 40 may be juxtaposed with regions of the belt 20 not having tie yarns 30 nearby. Such an arrangement provides a belt 20 having piles 40 which mitigate and/or reduce sleaziness within the plane of either a single layer belt 20 or a multi-layer belt 20.

Prophetically, the piles 40 may also provide improved seam strength for the belt 20. The piles 40 joined together adjacent yarns 30 in the machine direction, preventing such yarns 30 from becoming disentangled or otherwise separating at the seam.

As noted above, the elevations of the distal ends 44 of the piles 40 may be disposed at suitable and predetermined elevations. For example, the distal ends 44 of the piles 40 may intercept the tie yarns 30. Alternatively, the proximal ends 42 of the piles 40 may intercept the tie yarns 30. This arrangement may be used with multi-layer fabrics 22 having integral tie yarns 30, adjunct tie yarns 30, or both.

Of course, it is to be recognized that the distal ends 44 of the piles 40 may have various XY geometries. For example, the distal ends 44 of some piles 40 may be sized to provide support throughout the machine direction length of the knuckles 36. Alternatively, the distal end 44 of a single pile 40 may be sized to support two or more knuckles 36. All such variations are contemplated to be within the scope of the present invention.

What is claimed is:

1. A papermaking belt having a top surface plane and a backside opposed thereto, said belt comprising:

a fabric having a plurality of interwoven yarns; and a plurality of piles, each said pile extending from a proximal end juxtaposed with said back side to a distal end, said distal end being intermediate said backside and said top surface plane, said pile intercepting a yarn, whereby said pile acts as a column supporting said yarn from deflection due to compressive loads applied perpendicular to the plane of the belt, said belt being selected from the group consisting of a forming wire, a backing wire for a twin wire former, a transfer fabric, a base for a press felt, and a through drying fabric.

2. A belt according to claim 1 wherein each said pile intercepts a yarn, said piles supporting said yarns from deflection within the plane of said belt.

3. A belt according to claim I wherein each said pile intercepts a yarn, said piles supporting said yarns from deflection normal to the plane of said belt.

4. A papermaking belt having a top surface plane and a backside opposed thereto, said belt comprising: a fabric having a plurality of interwoven yarns; and a plurality of piles, each said pile extending from a proximal end juxtaposed with said backside to a distal end, said distal end being intermediate said backside and said top surface plane, said pile intercepting a yarn, whereby said pile acts as a column supporting said yarn from deflection due to compressive loads applied perpendicular to the plane of the belt, said belt being selected from the group consisting of a forming wire a backing wire for a twin wire former, a transfer fabric, a base for a press felt, and a through drying fabric, wherein said piles are discrete.

5. A belt according to claim 4 wherein said fabric comprises warps and shutes woven in a pattern to providing long knuckles, said long knuckles being comprised of a warp or a shute, and having a length sufficient to span two shutes or two warps, respectively.

6. A belt according to claim 5 wherein said piles are registered with said long knuckles.

7. A belt according to claim 6 wherein said warps and said shutes comprising said long knuckles have a mid-plane, and said distal ends of said piles are juxtaposed with said mid-plane.

8. A belt according to claim 1 wherein said piles extend from proximal ends juxtaposed with said backside of said belt.

9. A belt according to claim 1 wherein said piles comprise resin.

10. A multi-layer papermaking belt having a top surface plane and a backside opposed thereto, said belt comprising:

a first plurality of yarns woven to form a first layer defining said top surface plane;

a second plurality of yarns woven to form a second layer defining said backside, said first layer and said second layer being joined in face-to-face relation; and a plurality of piles, said piles extending from proximal ends juxtaposed with said backside to distal ends, said distal ends being intermediate said backside and said top surface plane, whereby said piles act as columns supporting said yarns of said first layer from deflection due to compressive loads applied perpendicular to the plane of the belt.

11. A belt according to claim 10 wherein said piles are discrete.

12. A belt according to claim 10 wherein said proximal ends of said piles intercept said yarns of said second layer.

13. A belt according to claim 10 wherein said proximal ends of said piles are juxtaposed with said backside of said belt.

14. A belt according to claim 12 further comprising a second plurality of piles extending from proximal ends, said proximal ends of said second plurality of piles being juxtaposed with said backside of said belt.

15. A belt according to claim 10 wherein said distal ends of said first plurality of piles are disposed at a first elevation above said backside of said belt, said belt further comprising a second plurality of piles, said second plurality of piles having distal ends disposed at a second elevation above said backside of said belt, said second elevation being different than said first elevation.

16. A belt according to claim 14 wherein said piles support said yarns from deflection normal to said belt.

17. A belt according to claim 15 wherein said belt comprises a dual layer fabric.

18. A papermaking belt, said belt having a top surface plane and a backside opposed thereto, said belt comprising:

a multi-layer fabric, said fabric having a first plurality of yarns in a first layer and a second plurality of yarns in a second layer; and a plurality of piles not extending outwardly beyond said top surface plane, said piles having proximal ends juxtaposed with said backside and connecting portions of said first plurality of yarns with portions of said second plurality of yarns registered therewith, whereby said piles act as columns supporting said first plurality of yarns and said second plurality of yarns from deflection relative to each other due to compressive loads applied perpendicular to the plane of the belt.

19. A belt according to claim 18 for imprinting paper thereon with two different imprint densities, a first imprint density and a second imprint density, said first imprint density being greater than said second imprint density.

20. A belt according to claim 19, having a first plurality of piles with proximal ends juxtaposed with said backside, and a second plurality of piles with proximal ends juxtaposed with said yarns of said second layer.

21. A belt according to claim 17, wherein said multi-layer fabric is a triple layer fabric.

* * * * *